US011774077B1

(12) United States Patent
Zhou

(10) Patent No.: US 11,774,077 B1
(45) Date of Patent: Oct. 3, 2023

(54) FOLDABLE DEVICE, LAMP AND METHOD OF USE THEREOF

(71) Applicant: Wenfeng Zhou, Jiujiang (CN)

(72) Inventor: Wenfeng Zhou, Jiujiang (CN)

(73) Assignee: WENFENG ZHOU, Jiujiang (CN)

( * ) Notice: Subject to any disclaimer, the term of this patent is extended or adjusted under 35 U.S.C. 154(b) by 0 days.

(21) Appl. No.: 17/889,324

(22) Filed: Aug. 16, 2022

(30) Foreign Application Priority Data

Jul. 1, 2022 (CN) ..... 202210768579.0

(51) Int. Cl.
*F21V 21/30* (2006.01)
*F21V 21/26* (2006.01)
*F21S 2/00* (2016.01)

(52) U.S. Cl.
CPC ..... *F21V 21/30* (2013.01); *F21S 2/005* (2013.01); *F21V 21/26* (2013.01)

(58) Field of Classification Search
CPC ..... F21V 21/30; F21V 21/26; F21S 2/005
See application file for complete search history.

(56) References Cited

U.S. PATENT DOCUMENTS 8,308,324 B2 * 11/2012 Van Horn ..... F21V 21/02 362/427
2010/0083468 A1 * 4/2010 Lin ..... F21S 6/003 16/387
2018/0087755 A1 * 3/2018 Yorio ..... F21V 17/007
2020/0041109 A1 * 2/2020 Van Der Schyf ..... F21V 21/14

FOREIGN PATENT DOCUMENTS

CN 111336478 A 6/2020
CN 213628473 U 7/2021
CN 213628474 U * 7/2021

OTHER PUBLICATIONS

Machine translation of Chen et al., CN 213628474, published Jul. 6, 2021 (Year: 2021).*

* cited by examiner

*Primary Examiner* — William N Harris
(74) *Attorney, Agent, or Firm* — FIDELI LAW PLLC

(57) ABSTRACT

A foldable device, a lamp and a method of use thereof are provided. The foldable device includes a hinge connector, at least two frames and at least two hinge bases, each of two ends of the hinge connector are connected to one end of the at least two hinge bases via a connection shaft; another ends of the hinge bases are connected to the frame via an elastic structure; the hinge base is provided with a fixed shaft on a side near the elastic structure; a guide slot is further provided on a side of the frame, and the fixed shaft may slide along the guide slot to fold or unfold the frames. The foldable device may save space and facilitate the transportation.

20 Claims, 4 Drawing Sheets

B-B

C-C

FOLDABLE DEVICE, LAMP AND METHOD OF USE THEREOF

RELATED APPLICATION

This application claims the benefit of priority of Chinese application No. 2022107685790, filed on Jul. 1, 2022, and the contents of the foregoing document are incorporated herein by reference in their entirety.

TECHNICAL FIELD

The present disclosure relates to the technical field of foldable illumination devices, and specifically relates to a foldable device, a lamp and a method of use thereof.

BACKGROUND

Decorative lamps are not only a part of modern home, but also an indispensable part of many industrial venues. The lamps have seen rapid changes, a variety of decorative lamps emerge. The requirements for decorative lamps include attractive appearance, easy maintenance, etc.

Among decorative lamps, long lamps are required in some application scenarios for decoration or certain specific lighting effects. For such long lamps, it is necessary to consider whether they can be easily transported and installed.

BRIEF SUMMARY

Therefore, the present disclosure provides a foldable device, including a hinge connector, at least two frames and two hinge bases, both ends of the hinge connector are respectively connected to one end of the hinge base by a connection shaft; the other end of the hinge base is connected to the frame by an elastic structure; the hinge base is configured with a fixed shaft on the side near the elastic structure; a guide slot is further provided on the side of the frame, and the fixed shaft slides along the guide slot to achieve the folding and unfolding of the frame.

The present disclosure provides a foldable device, including a hinge connector; at least two frames; and at least two hinge bases, where two ends of the hinge connector are respectively hinged to an end of each of the at least two hinge bases via a connection shaft, another end of each of the at least two hinge bases is connected to the at least two frames via an elastic structure, each of the hinge base includes a fixed shaft on a side close to the elastic structure, at least one guide slot is arranged on a side of each of the at least two frames, and the fixed shaft is slidable in the at least one guide slot to fold or unfold the at least two frames.

The present disclosure further provides a foldable lamp, including: a foldable deice; and an illumination source arranged on the foldable deice, where the foldable deice includes: a hinge connector, at least two frames, and at least two hinge bases, where two ends of the hinge connector are respectively hinged to an end of each of the at least two hinge bases via a connection shaft, another end of each of the at least two hinge bases is connected to the at least two frames via an elastic structure, each of the hinge base includes a fixed shaft on a side close to the elastic structure, at least one guide slot is arranged on a side of each of the at least two frames, and the fixed shaft is slidable in the at least one guide slot to fold or unfold the at least two frames.

The present disclosure further provides a method for using a foldable lamp, including:

(1) For unfolding the lamp, the at least two frames are firstly opened on the same plane, the hinge base and the hinge connector are pulled by the elastic structure to make the fixed shaft on the hinge base to slide along a guide slot on a side of the frame toward a center of each of the at least two frames, the hinge base drives the hinge connector to enter the frame, and stops of the at least two frames abut against each other, so as to unfold the at least two frames.

(2) For folding the lamp, the at least two frames are pulled in a direction away from the hinge connector, the hinge base and the hinge connector overcome the resistance of the elastic structure, such that the hinge base is pulled to slide along the guide slot toward the hinge connector until a predetermined angle between the hinge connector and the hinge base is reached, so as to fold the at least two frames.

The present disclosure has the following advantages: The present disclosure provides a foldable device, including: an elastic structure, a hinge base, a hinge connector and a frame. A guide slot is provided on the side of the frame, and the hinge base sliding along the guide slot under the traction of the elastic structure to achieve 180 degree rotation between adjacent frames, so as to fold and unfold the frame, thereby saving space and facilitating the carrying and transportation, and avoiding damages in transportation caused by the long frame.

When the foldable device is unfolded, the illumination source fixed to the foldable device may be exposed for illumination to expand the illumination range. When illumination is not needed, the foldable device may be folded and stored, thereby reducing the space occupied and enhancing the stability of the folded lamp during transportation.

BRIEF DESCRIPTION OF THE DRAWINGS

To clearly illustrate the technical solutions and advantages of the present disclosure, the following is a brief introduction to some exemplary embodiments of the present disclosure. It is obvious that the following descriptions of the accompanying drawings are only some exemplary embodiments of the present disclosure. Other drawings may also be obtained by a person skilled in the art based on these drawings without creative efforts.

DESCRIPTION OF ELEMENT SYMBOLS

1—Spring;
2—Fixed shaft;
3—Hinge base;
4—Frame;
5—Connection shaft;
6—Hinge connector;
7—Light board;
8—First stop;
9—Second stop.

DETAILED DESCRIPTION

The technical solutions in some exemplary embodiments of the present disclosure will be described in combination with the accompanying drawings. The described embodiments are only some exemplary embodiments of the present disclosure, not all of the embodiments. Based on these exemplary embodiments of the present disclosure, other embodiments obtained by those of ordinary skilled in the art without involving incentive skills fall within the scope of protection of the present disclosure.

In the present disclosure, it should be noted that terms "install", "connect" are understood in a broad sense unless otherwise explicitly specified, for example, a connection may be a fixed connection, a removable connection, or an integrated connection; a connection may be a mechanical connection, an electrical connection, a direct connection, or an indirect connection via an intermediate element; it may also be the communication between two components. The specific meanings of the above terms can be understood by those of ordinary skilled in the art in the contexts thereof.

In addition, the technical features involved in different exemplary embodiments of the present disclosure may be combined as long as no conflicts occur.

The present disclosure provides a foldable device, including a hinge connector, at least two frames, and at least two hinge bases; two ends of the hinge connector are respectively connected to one end of the hinge bases via a connection shaft; another end of the hinge base is connected to the frame via an elastic structure; the hinge base is provided with a fixed shaft on a side thereof near the elastic structure; a guide slot is further provided on a side of the frame, and the fixed shaft is configured to slide along the guide slot to fold or unfold the frames.

Figure 1:
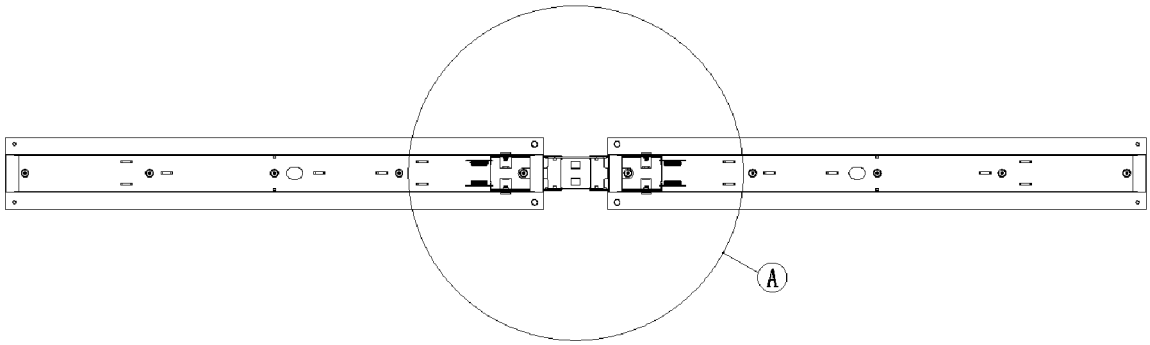
FIG. 1 is a schematic diagram of a foldable device according to some exemplary embodiments of the present disclosure.
Figure 2:
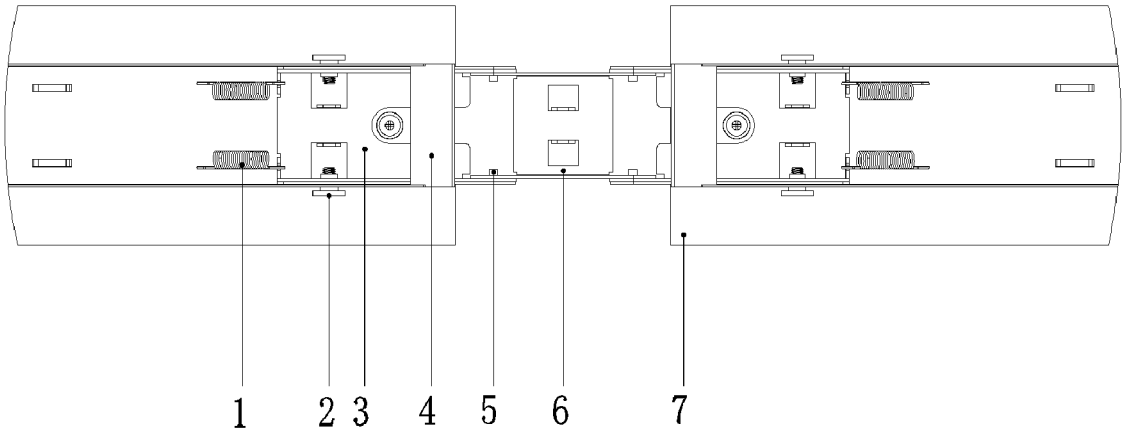
FIG. 2 is a partial schematic diagram of a foldable device according to some exemplary embodiments of the present disclosure.
Figure 3:
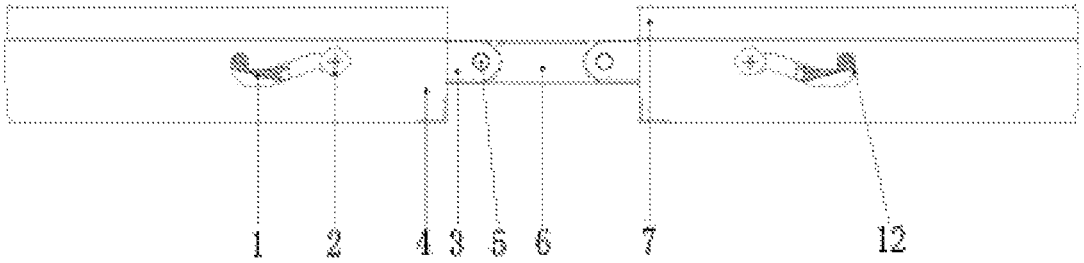
FIG. 3 is a side view of a foldable device according to some exemplary embodiments of the present disclosure.

FIG. 1 is a schematic diagram of the foldable device according to some exemplary embodiments of the present disclosure, FIG. 2 is a partial schematic diagram according to some exemplary embodiments of the present disclosure and FIG. 3 is a side view thereof according to some exemplary embodiments of the present disclosure.

In some exemplary embodiments of the present disclosure, two symmetrically arranged frames are indirectly connected by a hinge connector 6 in the middle, two springs 1 are arranged on one end of the frames 4, the other end of the spring 1 is connected to the hinge base 3, the fixed shaft 2 is configured to a side of the hinge base 3, and the hinge base 3 and the hinge connector 6 are hinged together via a connection shaft 5. The other frame has a same structure. The hinge connector 6 is a rectangular or frame structure having a regular structure.

In practice, the spring 1 may have a certain elastic force to pull the hinge base 3 and the hinge connector 6 in the process of unfolding or folding the frames, so as to ensure a certain tension in the entire folding or unfolding process, such that the process may carry out smoothly.

The structure including the spring 1, the hinge base 3 and the hinge connector 6 may facilitate the unfolding and folding of the two frames. The device may be folded in the transportation to help transport more devices. This may reduce the transportation cost and improve the stability of the devices during transportation. In addition, it is convenient to unfold and install the device to have a better installation result.

In some exemplary embodiments, the guide slot 10 may be arc-shaped, and a clamping structure 12 may be provided at one end thereof.

Figure 4:
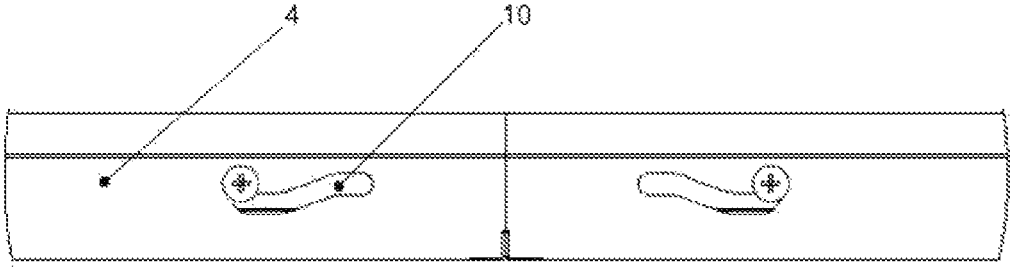
FIG. 4 is a schematic diagram of a guide slot of a foldable device according to some exemplary embodiments of the present disclosure.

FIG. 4 is a schematic diagram of a guide slot 10 the foldable device according to some exemplary embodiments of the present disclosure. As shown in FIG. 4, the fixed shaft can slides in the guide slot 10. The guide slots 10 mainly guide the hinge base to slide, making the hinge base move along a controlled trajectory during the folding or unfolding of the frames.

In some exemplary embodiments, the fixed shaft may be a positioning pin.

In some exemplary embodiments, one end of the guide slot 10 is provided with a clamping structure 12. When the frame is fully unfolded, the hinge base 3 and the hinge connector 6 retract inward along the arc-shaped guide slot 10 driving by the spring 1, and finally the fixed shaft 2 is clamped inside the clamping structure 12 of the arc-shaped guide slot 10, thus realizing the unfolding and fixing of two adjacent frames.

In some exemplary embodiments, the hinge base may be connected to the hinge connector by a hinge.

In some exemplary embodiments, the hinge may be used to rotate and flip the hinge connector to provide flexible connection.

In some exemplary embodiments, the hinge base and the hinge connector may also be connected in such a way that a right-angle/circular slot is provided in the hinge base, and an end of the hinge connector is provided with a projection to facilitate moving in the right-angle/circular slot.

In some exemplary embodiments, each of the two ends of the at least two frames is provided with a stop to abut against the frames during an unfolding process. After the frame is unfolded, a lower end of the stop abuts against an upper end of the hinge connector, and a side of a stop abuts against a side of a stop on an adjacent frame.

Figure 5:
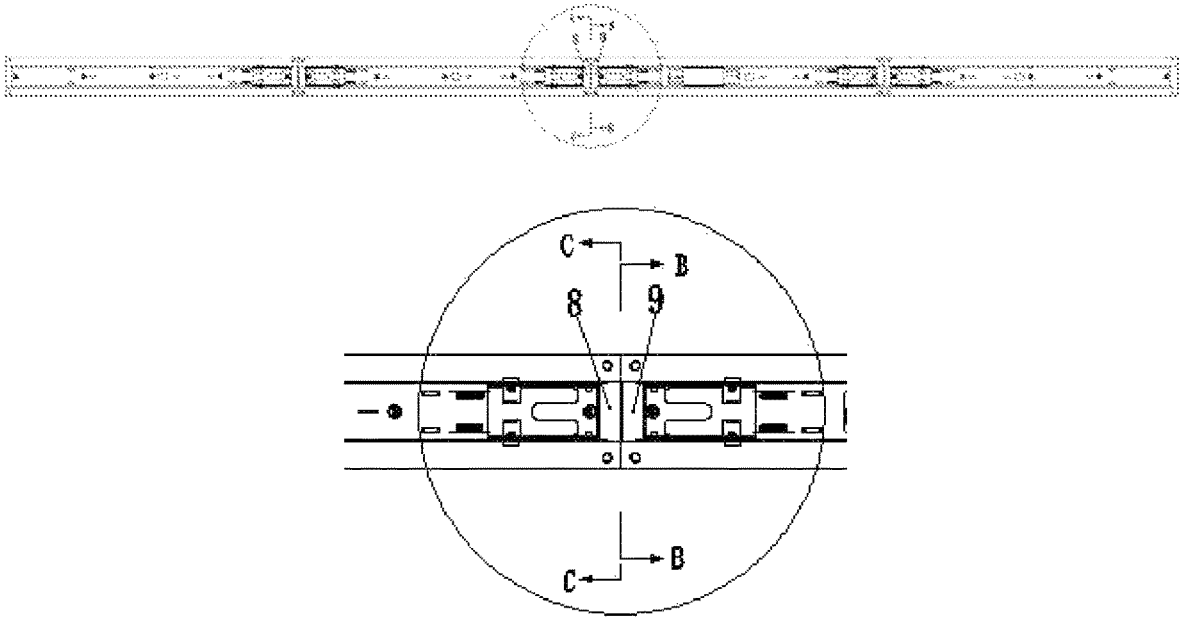
FIG. 5 is a schematic diagram of a foldable device in an unfolded state according to some exemplary embodiments of the present disclosure, where the lower panel is an enlarged partial view to indicate the viewing direction B (B-B) and the viewing direction C (C-C)

FIG. 5 is a schematic diagram of a foldable device in an unfolded state according to some exemplary embodiments of the present disclosure; FIG. 5 shows a stop 8 and a stop 9 abutting against each other.

In some exemplary embodiments, adjacent ends of two adjacent frames are provided with the stops, and the abutting surfaces of the first stop 8 and the second stop 9 are fully attached to each other after the unfolding process is completed. In addition, lower ends of the first stop 8 and the second stop 9 abut against the upper ends of the hinge connectors located below the stops. This stop structure may partially offset the force of the spring 1, meanwhile, the elasticity of the spring 1 makes adjacent frames more stable when they are unfolded in a straight line, thereby preventing the hinge connector and the hinge base in the frame from tilting under the force of the elastic structure, which may result in unnecessary flipping during a folding process.

In some exemplary embodiments, the elastic structure connected to one end of the frame may be a spring.

In some exemplary embodiments, the elastic structure connected to one end of the frame may be two springs in parallel, so that the hinge base may be more evenly stressed in an extending process.

In some exemplary embodiments, the elastic structure connected to one end of the frame may be a spring, and the specific type of the spring may be selected according to the forces applied to the hinge base during the unfolding or folding. The spring may be arranged on a center line of the hinge base 3.

In some exemplary embodiments, the elastic structure connected to one end of one of the frames may be silicone rubber with good elasticity.

In some exemplary embodiments, the elastic structure connected to one end of one of the frames may be two or more springs.

In some exemplary embodiments, there are at least two guide slots, and the at least two guide slots may be arranged symmetrically on a side of the frame.

In some exemplary embodiments, the guide slots may be arranged symmetrically on sides of contact ends of adjacent frames, and such a symmetrical setting of the guide slots makes the hinge bases slide back and forth in the guide slots more smoothly.

In some exemplary embodiments, when the at least two frames are folded, the hinge connectors are located outside the frames and the hinge bases are located partially outside the frames. When the at least two frames are unfolded, the hinge connector and the hinge base are both located inside the bodies of the frames.

In practice, when the frame is unfolded, all of the connecting parts are retracted into the frames to prevent interfering with the connections of other parts; when the frame is folded, some of the connection parts may be located outside of the frames.

In some exemplary embodiments, the end where the stop is located may have a cavity 11 to allow the hinge connector to pass therethrough.

In practice, a lower end of the stop may have an opening structure to facilitate the hinge connector and hinge base to pass therethrough during a folding or unfolding process.

In some exemplary embodiments, the frame may be provided with a recess for accommodating the hinge connector, the hinge base and the elastic structure.

In practice, the frame may be provided with a recess structure, the recess structure may accommodate the hinge connector, the hinge base and the elastic structure so as to reduce collisions during a folding or unfolding process.

FIG. 5 is a schematic diagram of a foldable device in an unfolded state according to some exemplary embodiments of the present disclosure.

As showed in FIG. 5, the foldable device may include four frames connected in sequence from left to right, where a left end or right of the frame structures in the middle is connected to another frame structure.

In some exemplary embodiments, a fully folded lamp is only a quarter in the length of an unfolded one, thereby greatly reducing the space occupied by the lamp.

In some exemplary embodiments, the number of frames may be increased or reduced as needed. Theoretically, the number of frames may be extended indefinitely, so that multiple foldable frames connected together may greatly reduce the installation time, and save the labor cost; in addition, as no additional accessories are required, the installation and use thereof are easy and convenient.

Figure 6:
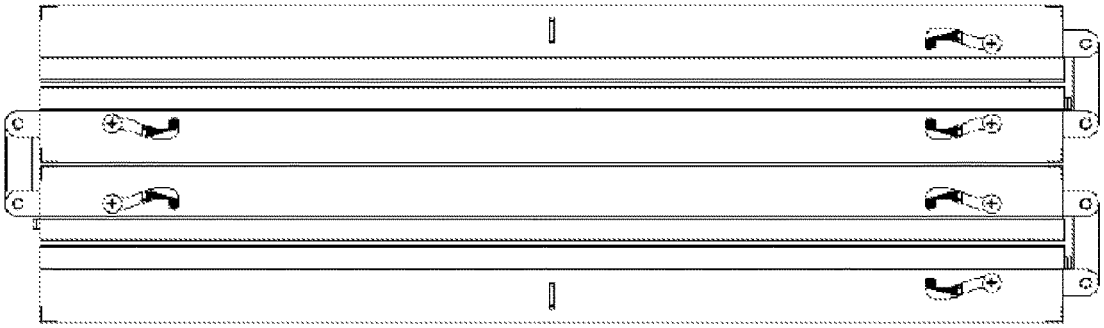
FIG. 6 is a schematic diagram of a foldable device in a folded state according to some exemplary embodiments of the present disclosure.
Figure 7:
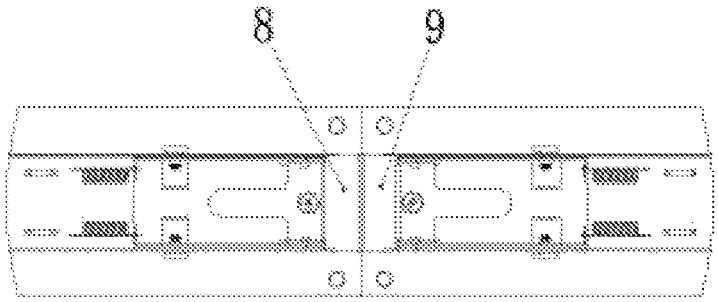
FIG. 7 is an enlarged partial view of FIG. 5 to illustrate the stops.
Figure 8:
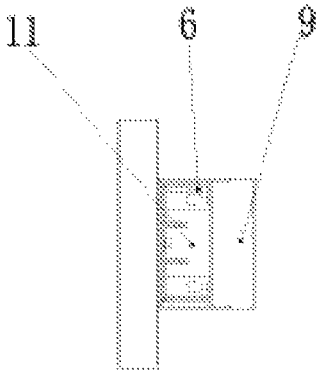
FIG. 8 is an enlarged partial view of FIG. 5 based on the viewing direction B (B-B)
Figure 9:
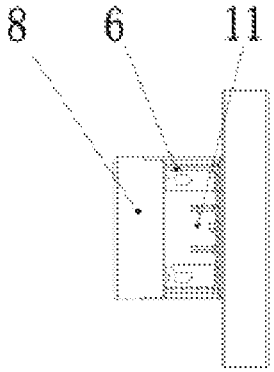
FIG. 9 is an enlarged partial view of FIG. 5 based on the viewing direction C (C-C).

FIG. 6 shows a four-frame foldable structure a foldable device according to some exemplary embodiments of the present disclosure. As showed in FIG. 6, the foldable lamp may reduce the space occupied, and is convenient to carry and transport.

The present disclosure provides a foldable lamp, including: a foldable device as previously described and an illumination source fixedly arranged on the foldable device.

In some exemplary embodiments, the frame may be provided with a thread hole(s) or another clamping structure to fix an illumination source light board 7. After the frame is unfolded, the illumination source light board 7 may be connected into a straight line, according to the actual illumination effect need, different illumination sources may be provided on different frames, and then connected to the power supply in use. Thus, the installation is convenient. The form of the illumination source is not limited herein.

In practice, when the frame is folded, the decorative lamp may be removed for folding; and the decorative lamp may be fixed to the frame after the frame is unfolded. Alternatively, the decorative lamp may also be always fixed to the frame as needed.

By providing the illumination source on the foldable device, through unfolding or folding the foldable device, the lamp may be unfolded or folded accordingly.

The present disclosure further provides a method of using the foldable lamp for unfolding or folding the previously described lamp. The method may include the steps below.

(1) For unfolding the lamp, the at least two frames are firstly opened on the same plane, the hinge base and the hinge connector are pulled by the elastic structure to make the fixed shaft on the hinge base to slide along a guide slot on a side of the frame toward a center of each of the at least two frames, the hinge base drives the hinge connector to enter the frame, and stops of the at least two frames abut against each other, so as to unfold the at least two frames.

(2) For folding the lamp, the at least two frames are pulled in a direction away from the hinge connector, the hinge base and the hinge connector overcome the resistance of the elastic structure, such that the hinge base is pulled to slide along the guide slot toward the hinge connector until a predetermined angle between the hinge connector and the hinge base is reached, so as to fold the at least two frames.

In some exemplary embodiments, in an unfolding or folding process, the elasticity of the elastic structure and the guidance from the guide slots guide facilitate the unfolding and folding of the frames. In addition, the both the unfolded structure and the folded structure are stable and free of flipping.

The above exemplary embodiments are merely illustrative for description, and are not intended to limit the present disclosure. For a person skilled in the art, variations or changes may be made in different forms based on the above descriptions. These variations and changes also fall within the scope of protection of the present disclosure.

What is claimed is:

1. A foldable device, comprising:

a first frame including a first recess structure and a second frame including a second recess structure;

a first hinge base at least partially in the first recess structure and being slidable with respect to the first frame, and a second hinge base at least partially in the second recess structure and being slidable with respect to the second frame;

a hinge connector, connected to the first hinge base via a first hinge connection and connected to the second hinge base via a second hinge connection to fold or unfold the first frame and the second frame; and a first elastic structure connecting the first hinge base to the first frame, and a second elastic structure connecting the second hinge base to the second frame, wherein when the first frame and the second frame are unfolded:

a first part of the hinge connector is pulled by the first elastic structure to slide into the first recess structure and is clamped in the first recess structure, and a second part of the hinge connector is pulled by the second elastic structure to slide into the second recess structure and is clamped in the second recess structure, so that the first frame and the second frame abut against each other via stops.

2. The foldable device according to the claim 1, wherein the stops are arranged on adjacent ends of the first frame and the second frame to abut against each other when the first frame and the second frame are unfolded;

the first frame includes a first guide slot and the second frame includes a second guide slot;

the first hinge base includes a first fixed shaft slidable in the first guide, so that the first hinge base is slidable with respect to the first frame; and the second hinge base includes a second fixed shaft slidable in the second guide, so that the second hinge base is slidable with respect to the second frame.

3. The foldable device according to claim 2, wherein following unfolding first frame and the second frame, lower ends of the stops abut against an upper end of the hinge connector.

4. The foldable device according to claim 1, wherein the first frame includes a first guide slot having a first clamping structure at one end, and the second frame includes a second guide slot having a second clamping structure at one end;

the first hinge base includes a first fixed shaft slidable in the first guide slot, so that the first hinge base is slidable with respect to the first frame; and the second hinge base includes a second fixed shaft slidable in the second guide slot, so that the second hinge base is slidable with respect to the second frame, wherein when the first frame and the second frame are unfolded, the first fixed shaft engages with the first clamping structure to clamp the first part of the hinge connector in the first recess structure and the second fixed shaft engages with the second clamping structure to clamp the second part of the hinged connector in the second recess structure.

5. The foldable device according to claim 1, wherein the first and second elastic structures are springs.

6. The foldable device according to claim 5, wherein the first guide slot and the second guide slot are symmetrically arranged on the first frame and the second frame, respectively.

7. The foldable device according to claim 6, wherein following folding the first and second frames, the hinge connector is located outside the first and second frames, and the two hinge bases are partially located outside the first and second frames.

8. The foldable device according to claim 7, wherein following unfolding the first and second frames, the hinge connector and the first and second hinge bases are located inside the first and second frames.

9. The foldable device according to claim 1, wherein each of the ends where the stops are located includes a cavity to allow the hinge connector to pass therethrough.

10. The foldable device according to claim 9, wherein the recess structures accommodate the hinge connector, the first and second hinge bases, and the first and second elastic structures.

11. A foldable lamp, comprising:

a foldable device; and an illumination source arranged on the foldable device, wherein the foldable device includes:

a first frame including a first recess structure and a second frame including a second recess structure;

a first hinge base at least partially in the first recess structure and being slidable with respect to the first frame, and a second hinge base at least partially in the second recess structure and being slidable with respect to the second frame;

a hinge connector, connected to the first hinge base via a first hinge connection and connected to the second hinge base via a second hinge connection to fold or unfold the first frame and the second frame; and a first elastic structure connecting the first hinge base to the first frame, and a second elastic structure connecting the second hinge base to the second frame, wherein when the first frame and the second frame are unfolded:

a first part of the hinge connector is pulled by the first elastic structure to slide into the first recess structure and is clamped in the first recess structure, and a second part of the hinge connector is pulled by the second elastic structure to slide into the second recess structure and is clamped in the second recess structure, so that the first frame and the second frame abut against each other via stops.

12. The foldable lamp according to claim 11, wherein the stops are arranged on adjacent ends of the two frames first frame and the second frame to abut against each other when the first frame and the second frame are unfolded;

the first frame includes a first guide slot and the second frame includes a second guide slot;

the first hinge base includes a first fixed shaft slidable in the first guide, so that the first hinge base is slidable with respect to the first frame; and the second hinge base includes a second fixed shaft slidable in the second guide, so that the second hinge base is slidable with respect to the second frame.

13. The foldable lamp according to claim 12, wherein following unfolding first frame and the second frame, lower ends of the stops abut against an upper end of the hinge connector.

14. The foldable lamp according to claim 11, wherein the first frame includes a first guide slot having a first clamping structure at one end, and the second frame includes a second guide slot having a second clamping structure at one end;

the first hinge base includes a first fixed shaft slidable in the first guide slot, so that the first hinge base is slidable with respect to the first frame; and the second hinge base includes a second fixed shaft slidable in the second guide slot, so that the second hinge base is slidable with respect to the second frame, wherein when the first frame and the second frame are unfolded, the first fixed shaft engages with the first clamping structure to clamp the first part of the hinge connector in the first recess structure and the second fixed shaft engages with the second clamping structure to clamp the second part of the hinged connector in the second recess structure.

15. The foldable lamp according to claim 11, wherein the first and second elastic structures are springs.

16. The foldable lamp according to claim 15, wherein the first guide slot and the second guide slot are symmetrically arranged on the first frame and the second frame, respectively.

17. The foldable lamp according to claim 16, wherein following folding the first and second frames, the hinge connector is located outside the first and second frames, and the two hinge bases are partially located outside the first and second frames.

18. The foldable lamp according to claim 17, wherein following unfolding the first and second frames, the hinge connector and the first and second hinge bases are located inside the first and second frames.

19. The foldable lamp according to claim 11, wherein each of the ends where the stops are located includes a cavity to allow the hinge connector to pass therethrough.

20. The foldable lamp according to claim 19, wherein the recess structures accommodate the hinge connector, the first and second hinge bases, and the first and second elastic structures.

* * * * *